United States Patent [19]

Wright

[11] Patent Number: 4,660,554

[45] Date of Patent: Apr. 28, 1987

[54] DUAL PURPOSE ATHLETIC BRIEF AND CUP SUPPORTER

[76] Inventor: Timothy D. Wright, 10316 Eagan, Whittier, Calif. 90604

[21] Appl. No.: 789,498

[22] Filed: Oct. 21, 1985

[51] Int. Cl.[4] ..... A61F 5/40

[52] U.S. Cl. ..... 128/158

[58] Field of Search ..... 128/158; 2/78 R

[56] References Cited

U.S. PATENT DOCUMENTS

| | | | |
|---|---|---|---|
| 521,176 | 6/1894 | Parker | 128/158 |
| 967,736 | 8/1910 | Delp | 128/158 |
| 1,020,588 | 3/1912 | West | 128/158 |
| 1,063,062 | 5/1913 | Quenzer | 128/158 X |

*Primary Examiner*—Gregory E. McNeill
*Attorney, Agent, or Firm*—Ben E. Lofstedt

[57] ABSTRACT

A combination athletic brief and cup supporter specially formed and constructed of approximately 13 percent Spandex/Lycra and 87 percent Nylon stretch material, including a brief having a waist and two openings for the legs of the brief wearer, and a cup pocket formed in the front portion of the brief by a single piece of material sewn thereon along the sides and bottom thereof to the front and along the bottom thereof.

The method of constructing said combination athletic brief and cup supporter is also disclosed.

8 Claims, 7 Drawing Figures

DUAL PURPOSE ATHLETIC BRIEF AND CUP SUPPORTER

BACKGROUND OF THE INVENTION

1. Field of the Invention

The within invention relates to undergarment briefs, and, more particularly, to a two piece, combination athletic brief and cup supporter, and additionally relates to a method of producing such a garment.

2. Description of the Prior Art

Traditionally, in any sports contact related competition, male participants wear jockstraps, with or without a protective cup for testicular protection. Such jockstrap garments consist of a waistband, a generally triangularly-shaped piece of material secured along its top portion to the waistband, serving to form a pouch for cradling the male's penis and testicles, and a pair of straps which are connected to the bottom end of the pouch to the side of the waistband oppositely disposed to the pouch attachment to the waistband. The pouch usually consists of a pocket with closure snaps along the uppermost portion thereof designed for the purpose of receiving a rigid, protective cup designed to cover the male's penis and testicles, thereby protecting the male's private parts from damage due to hard blows. In order to fit snugly against the body of the wearer, the garment is constructed of an elastic material. Such garments are commonly referred to as "jockstraps".

However, such conventional jockstraps have traditionally had numerous problems.

One such typical, frequently-encountered problem is that the elastic straps of such jockstraps instead of remaining flat against the buttocks of the wearer, have a tendency to roll inwardly to the innermost edge of the buttocks, causing testicular irritation and uncomfortable, irritating and annoying blockage to the anus, a very sensitive area of the human body.

Another problem resident in the use of such conventionally constructed jockstraps is the fact that due to the more-than-normal body movements encountered in sports activities, and the garment's stress concentrations created by a combination of the extreme body movements encountered in typical sports' activities, the jockstrap design and the mode of construction of garments, the elastic material is quickly overstressed and exceeds the yield point of the elastic material. Once the yield point of the material is exceeded, the elastic material will not return to its former unstretched condition. Consequently, the jockstrap will no longer hug the contour of the buttocks and/or the penis and testicles of the wearer. When this occurs, the protection afforded by the jockstrap is severely reduced due to the lack of conformity to the body's contours. For example, as a result of such looseness created by a loss of the fabric's elasticity, the protective cup in the pouch may be shifted from one side to another at times uncovering the male's private parts. If the area of the male's private parts should be typically encountered in strenuous sports' activities, the protective cup will no longer function as a protective device, it now becomes a dangerous instrumentality which, if hit, will cause injury to the male privates.

Another problem presented in the use of such traditional, prior art jockstraps is that of sanitation. The design of such a skimpy garment a discussed previously tends to congregate and bunch-up in intimate contact with the outlet of the anal cavity. Since the entrance to, and the area immediately surrounding the anus is typically not totally free from fecal matter, and other excretory fluids, the straps tend to absorb such materials which are highly acidic and/or laden with bacteria. The absorption of such materials into the straps poses a serious sanitation problem, as well as causing rapid deterioration of the elastic fabric forming such straps.

The snap closures used in the typical jockstrap creates problems of irritation and sanitation as well. Such snaps pose bacteria/germicical/sanitation problems in that such fasteners offer a plurality of receptacles in which such bacteria, germs, and other undesirable materials which create sanitation problems can, and do, reside. Such receptacles create a problem, perhaps not well recognized, to the user in the spread of disease and are odor causing because of their ability to house and contain such undesirable materials.

Further, the previously used and employed jockstraps are constructed of elastic material, typically including a substantial amount of cotton cloth. Elasticized cotton has a relatively short, useful life as compared to Spandex/Lycra and Nylon stretch materials.

Another problem with the prior art jockstraps is that they are relatively uncomfortable to wear after the sports' activities on a normal basis when not engaging in sports' activities.

An additionally undesirable feature of the prior art jockstraps is that they are visually unsightly.

Further, prior art jockstraps offer no support whatsoever to the buttocks of the user.

For these, as well as other, perhaps equally evident, disadvantages, the present invention was created.

SUMMARY OF THE INVENTION AND OBJECTS

Fundamentally, the present invention disclosed and described herein as a combination athletic brief and cup supporter specially formed and constructed of two pieces of Spandex/Lycra and Nylon stretch material, including a brief which is formed of a single piece of material have four arcuately shaped portions contoured therein and a continuous side mediately arranged therein, so that when folded along one of the sides and the other sides are aligned and joined by sewing the two open ends together and brief is formed having a waist and two openings for the legs of the brief wearer, and a cup pocket formed in the front portion of the brief by a single piece of material sewn thereon along the sides and bottom thereof to the front and along the bottom thereof.

One object of the invention is to provide a improved combination brief and atheletic cup supporter in one embodiment which is comfortable to wear on a day-round, regardless-of-use basis.

Another equally important and highly desirable object of the present invention is to provide a uniquely novel combination brief and athletic cup supporter for which is constructed of Spandex or Lycra and Nylon stretch fabric.

A yet still further object of the present invention is to provide some added contour and support for the buttocks.

Another primary and important object of the present invention is to provide a means for holding a wide range of different size cups.

One further object of the invention is to provide a brief which is capable of flexibility accomodating a range of sizes.

One yet still further object of the invention is to provide for an extremely comfortable and expandable combination brief and cup supporter.

Another primary and important object of the invention is to provide for an improved combination athletic brief and cup supporter which can be easily manufactured using only two pieces of material.

Another primary feature of the instant invention is to provide an athletic cup supporter which does not use any fasteners or devices which are required to keep the pouch closed in order to hold the protective cup.

A further important object of the instant invention is to provide an athletic sup supporter which eliminates the use of straps.

Another equally important feature and object of the present invention is to provide a unique combination brief and athletic cup supporter which is adapted for use for all sports.

Other features and characteristics of the invention disclosed herein will becoming increasingly and readily more apparent as the description proceeds further hereinafterwards, such description including the drawings which form a part of this application, in which:

DESCRIPTION OF THE PREFERRED EMBODIMENT OF THE INVENTION

Figure 1:
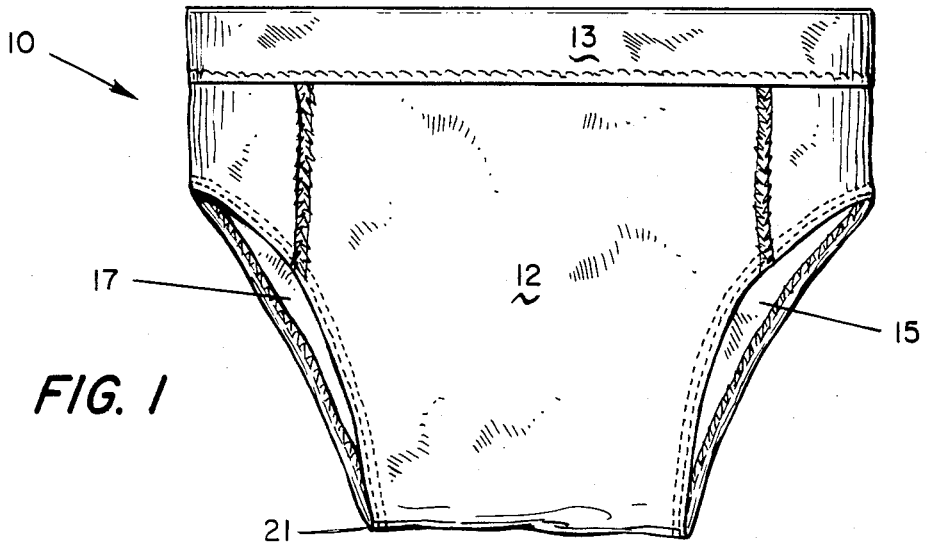
FIG. 1 is a front outside view of the new and unique combination dual purpose athletic brief and cup supporter as characterized by the present invention.

With continued reference to the drawings herein and with special emphasis now on FIG. 1, there is shown and described the new and improved dual purpose athletic brief and cup supporter generally identified at 10. Basically, the brief and cup supporter 10 body is formed of two pieces of a combination of Nylon and Spandex or Nylon and Lycra material which provides an inherent means for conformably hugging the body and the crouch area of the wearer, one of the pieces forming the brief generally indicated at 11 and the other of the pieces forming, in combination with the front portion of the brief, the cup supporter generally indicated at 12 and further consists of a waistband 13 encircling the top of the brief 10 with an elastic band 14 sewn therein to provide the necessary gripping force by which to engage the waist of the brief user, a first leg opening 15 the rim of which includes an elastic band 16 which is sewn thereinto in order to assist it with gripping the leg of the brief user, a second leg opening 17 the rim of which includes an elastic band 18 which is sewn thereinto in order to assist it with gripping the leg of the brief user, and a seam 19 sewn along one side of the brief 10.

Figure 2:
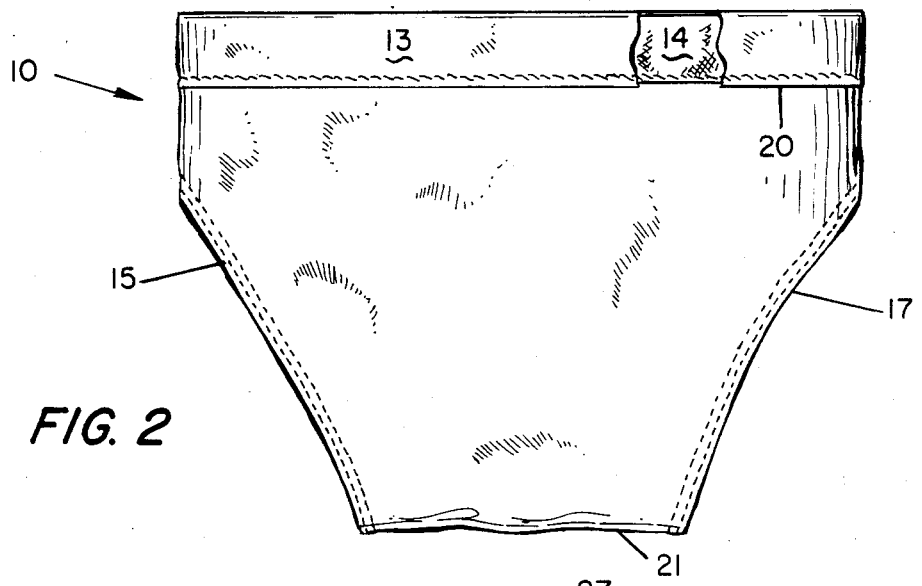
FIG. 2 is a rear outside view of the present invention.

FIG. 2 depicts a rear elevational view of the brief and cup supporter combination 10 depicting the waistband 13 with the elastic material 14 sewn therein with the circumferencially disposed sewn seam 20 and the elasticized first leg opening 15 and second leg opening 17, along with the bottom crouch seam 21.

Figure 3:
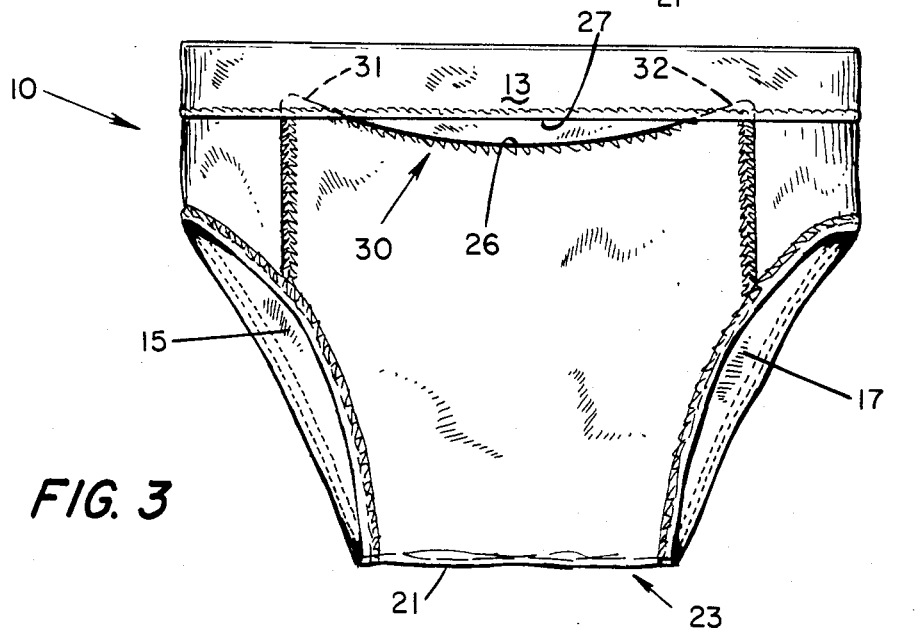
FIG. 3 is an inside front view of the present invention.

FIG. 3 illustrates the front elevational view of the brief and cup supporter 10 as viewed from the inside thereof. The view reveals the specific form of construction relative to how the cup supporter 12 is formed and integrated as part of the brief 11 with the piece of material forming the cup supporter 12 being attached to the inside front of the brief 11 by sewing the bottom portion 22 to the bottom of the crouch 23, and by sewing the two vertical edges 24, 25 of the cup supporter 12 to the front portion of the brief 11. The top edge 26 of the cup supporter 12 is arranged so as to be disposed immediately below the bottom edge 27 of the waistband 13

One of the purposes of disposing the top edge 26 of the cup supporter 12 immediately below the bottom edge 27 of the waistband 13 is to provide a stop means for the cup 28 after it is inserted into the pocket created by securing the two pieces of material together to form a cup supporter 12.

One of the critical aspects of this new brief and cup supporter 10 construction is that in order for it to function successfully it must be formed of a specific type of material; if not, it will not be successful in functioning in the desired fashion. The material is described as Nylon and Spandex or Nylon and Lycra. Preferrably, the material should be formed of 87% Nylon and 13% Spandex or 87% Nylon and 13% Lycra. The material composition could be varied by 3 to 5 percent and still function properly as disclosed herein. Use of this material creates a strong, yet fully elastic body which restrains every portion of the body which is covered by the brief and cup supporter 10. Further, the use of this particular material allows the completely uniform force exerted by the material forming the brief and cup supporter 10 to be spread uniformly over the entire cup 28 which is held in the pocket which forms the cup supporter 12, thereby ensuring that the cup 28 will be maintained in the position it was originally placed.

By using this construction and this specific material, a brief and cup supporter 10 is created without snaps or other fasteners which can bind or otherwise inhibit the wearer and/or create undesirable habitats for the generation and growth of germs, bacteria and other odor-causing mechanisms. With this material and the total absence of snaps or other fasteners in this brief and cup supporter, a new, unique and sanitary brief and cup supporter 10 is created satisfying a long-felt need in this product field.

Also, by the very nature of the construction form as described herein, the cup 28, once placed in the pocket forming the cup supporter 12, is significantly restrained from moving up and out of the pocket when hit or moved during significant activity of the wearer.

METHOD OF CONSTRUCTION

Figure 4:
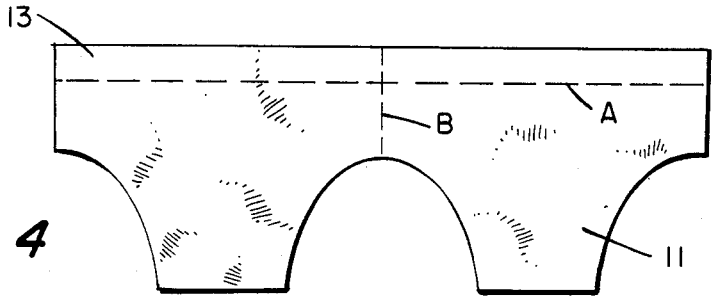
FIG. 4 is a plan view of the single piece of material which has been cut into a shape and contour from which the the athletic brief of the present invention is formed.
Figure 5:
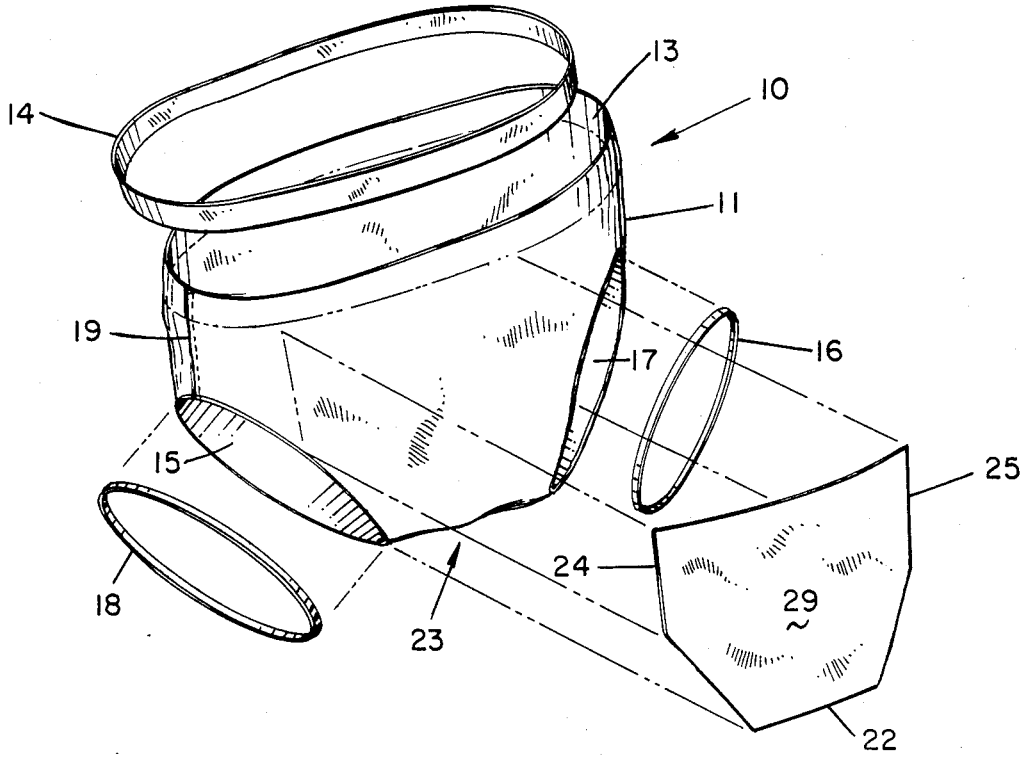
FIG. 5 is a generally perspective view of the fully constructed brief depicting in an exploded, assembly view form, precisely how the frontmost portion of the cup supporter portion is located and secured to the body of the athletic brief portion of the present invention.

With particular emphasis now on FIGS. 4 and 5, there is shown, in greatly simplified form, the primary method of constructing the combination brief and cup supporter 10 characterized by the present invention.

FIG. 4 depicts the single piece of material which forms the basic body of the brief 11. The fold lines A and B are the primary fold lines used in forming the product. Fold line A relates to the fold line for the material in which to house the elastic waistband. Fold line B is the fold line which relates to the unsewn side of the brief and cup supporter 10.

After the single piece of material is folded 180 degrees about fold line B, the opposite edges of the single piece of material which forms the other side of the brief 11 body, are sewn together to form a seam 19, thereby creating a basic brief 11.

Elastic bands 16, 18 are sewn in the leg openings as depicted in FIG. 5. The purpose of these elastic bands 16, 18 is to provide a means for the leg openings 15, 17 to be lockingly gripped about the legs of the wearer of the brief and cup supporter combination 10 of the present invention.

An elastic band 14 is sewn into and about the waistband 13 of the athletic brief and cup supporter 10. The purpose of the elastic waistband 14 is to provide a means for lockingly grip the brief and cup supporter 10 in a definite position about the waist of the brief and cup supporter wearer.

The second piece of material 29 which helps to form the pocket for the cup supporter is positioned as shown in the front of the brief 11 and sewn into position into the front of the brief 11 and along the bottom 22 of the crouch at 21. Once this is accomplished, the entire brief and cup supporter combination 10 is turned inside out, so that the second piece of the material 29 is now facing the inside of the brief and cup supporter combination 10.

Figure 6:
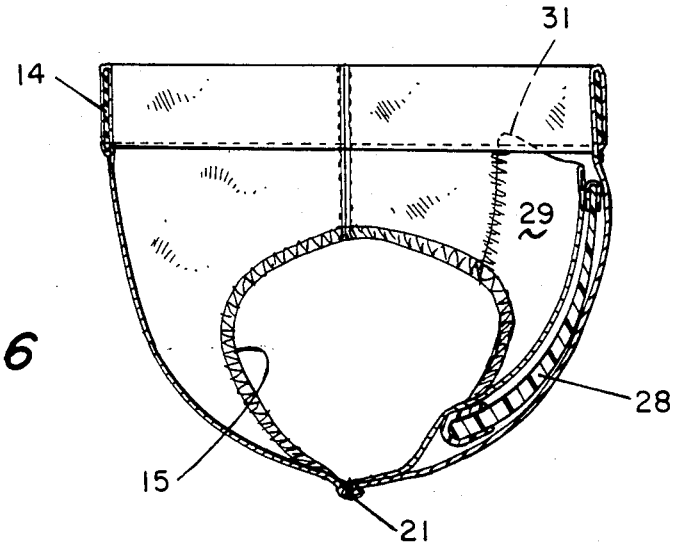
FIG. 6 is a side, vertically disposed, elevational view of the invention shown in full section, depicting the specific placement of the protective cup within the front pouch of the athletic supporters of the present invention.

The cutaway sectional view of FIG. 6 illustrates the construction arrangement as described herein before, and the preferred placement of the cup 28 within the pocket formed by the cup supporter portion 12 of the athletic brief and cup supporter combination 10.

With special reference now again to FIG. 3, the upper portion 30 of the cup supporter 12 of the within combination athletic brief and cup supporter 10 is secured to the waistband 13 by looping the upper ends 31, 32 thereof into the waistband 13 and sewn therein. The purpose and function of this construction is to provide not only for improved anchoring durability of the overall cup supporter 12 but to provide a means for ensuring that the upper edge 33 is projected slightly away from the waistband 13 whereby the cup supporter 12 is slightly open for ease of cup 28 insertion thereinto.

Figure 7:
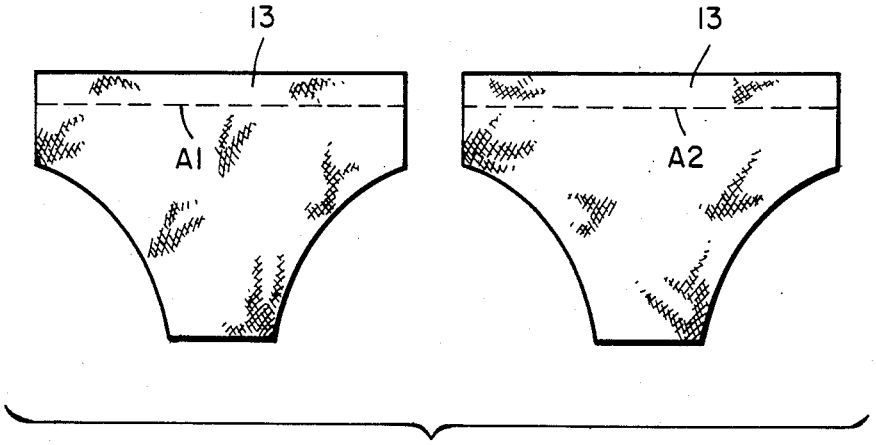
FIG. 7 is a plan view of the two pieces of material which are to be sewn together to form the body of the brief portion of the present invention.

Alternatively, the brief 11 could just as simply be formed of two pieces of material generally formed in the same shape as clearly depicted and shown in FIG. 7 of the Drawings wherein the mediate portion thereof is separated. To form a brief 11 using these two pieces would simply require that two sewn seams would be necessary along the sides of the brief 11 instead of a single seam 19 as shown in 11 might be desirable for the purpose of portraying a 'balanced' look for the brief 11 and/or might offer some further opportunities in the specific machinery which is used to cut, shape, form and sew the materials from which the brief 11 is constructed. Of course, the waistband fold lines would be now identified by fold lines A1 and A2 instead of fold line A.

This combination athletic brief and cup supporter 10 contains the only cup supporter 11 which provides for full, complete elastic coverage over the entire crouch area of the wearer and is similarly secured about the buttocks of the wearer of all which offers the user with a uniquely secure and comfortable cup supporter 11. Previous cup supporter 11 designs were used either alone or in combination with large full or mid-length briefs which failed to offer the opportunity to be used and incorporated into all sports activities, such swimming, water skiing, water polo, diving, jet skiing and the like.

Further, such combination brief 10 offers for the first time a cup supporter 12 and brief 11 combination 10 which can be welcomely worn even outside of such sports activities, thereby eliminating the need for carrying a separate pair of non-sport briefs for after-sport-activities use.

It should be clearly understood and realized that various modifications can be made to the above-described preferred embodiments, without departing from the spirit and scope of the invention. Further, as will be seen from the embodiments illustrated in the drawings, the previously described advantages may be readily and economically attained by the structure of the present invention.

What is claimed is:

1. An improved athletic brief and cup supporter combination, comprising:

(a) a brief formed of a combination Nylon-Spandex or Nylon-Lycra, comprising approximately 87 percent Nylon and 13 percent Spandex or Lycra, varying from 3 to 5 percent in such compositional mix, the brief having:

a waistband portion adapted to encircle the waist of the brief wearer, said waistband including an elastic band of material sewn therein to provide a means for intimately gripping the waist of the brief wearer;

a first leg opening in the brief with an elastic band sewn therein for encircling one of the legs of the brief wearer;

a second leg opening in the brief with an elastic band sewn therein for encircling the other of the legs of the brief wearer;

(b) a cup supporter, comprising:

a front panel of material formed of a combination Nylon-Spandex or Nylon-Lycra, comprising approximately 87 percent Nylon and 13 percent Spandex or Lycra, varying from 3 to 5 percent in such compositional mix, said front panel having a pair of oppositely-disposed arcuate portions thereon adapted to be alignably sewn to the leg portions and the elastic bands contained thereabout, a bottom portion adapted to be sewn to the bottom of the brief, a pair of oppositely-disposed, vertically-arranged edges sewn to the front portion of the brief, and a top portion having an elastic band sewn therein with a pair of looped portions at the opposite extremities thereof which are sewn to the waistband of the brief.

2. The combination athletic brief and cup supporter of claim 1, further comprising a vertically sewn seam along one side of the brief.

3. The combination athletic brief and cup supporter of claim 2, further comprising a vertically sewn seam along the other opposite side of the brief.

4. The combination athletic brief and cup supporter of claim 2 wherein said vertically sewn seam faces inwardly towards th inside the brief.

5. The combination athletic brief and cup supporter of claim 2 wherein both of said vertically sewn seams face inwardly towards the inside the brief.

6. The combination athletic brief and cup supporter of claim 1, further comprising a seam sewn along the bottom of the brief and the front panel forming the inside facing part of the cup supporter to operably join the bottom of the brief and the front panel together.

7. The combination athletic brief and cup supporter of claim 6, wherein said bottom seam faces inwardly inside the brief.

8. The combination brief of claim 1 wherein said front panel is sewn on the inside of the front portion of the brief.

* * * * *